United States Patent [19]

Brasch

[11] Patent Number: 4,877,450

[45] Date of Patent: Oct. 31, 1989

[54] FORMALDEHYDE-FREE ELECTROLESS COPPER PLATING SOLUTIONS

[75] Inventor: William R. Brasch, Nesconset, N.Y.

[73] Assignee: LeaRonal, Inc., Freeport, N.Y.

[21] Appl. No.: 314,537

[22] Filed: Feb. 23, 1989

[51] Int. Cl.[4] ..... C23C 3/02; C23C 16/00

[52] U.S. Cl. ..... 106/1.26

[58] Field of Search ..... 106/1.26

[56] References Cited

U.S. PATENT DOCUMENTS

| | | | |
|---|---|---|---|
| 3,431,120 | 3/1969 | Weisenberger | 106/1 |
| 3,870,526 | 3/1975 | Pearlstein et al. | 106/1 |
| 4,138,267 | 2/1969 | Arisato et al. | 106/1.23 |
| 4,143,186 | 3/1979 | Davis | 427/345 |
| 4,617,205 | 10/1986 | Darken | 106/1.26 |
| 4,684,550 | 4/1987 | Milius et al. | 427/437 |

*Primary Examiner*—Theodore Morris

*Attorney, Agent, or Firm*—Pennie & Edmonds

[57] ABSTRACT

This invention relates to a formaldehyde-free electroless copper plating solution, containing a solution soluble divalent copper compound in a concentration between about ½ and 2 g/l; a reducing agent for the copper compound in an amount of between about 1 and 3 g/l; a complexing and chelating agent mixture of between about 5 and 100 ml/l of an alkanol amine having at least one alkyl group with one to three carbon atoms and between about 1 and 10 g/l of an ethylene diamine compound of the formula

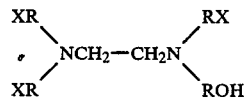

wherein R is an alkyl moiety having between 1 and 3 carbon atoms and X is —OH or —COOH; the solution preferably having a pH between about 7 and 8.5 and a temperature preferably between about 130° and 150° F., with the complexing and chelating agent mixture being present to provide stability to the solution and to enable the solution to provide a uniform plating rate of copper upon a substrate which is immersed therein.

22 Claims, No Drawings

FORMALDEHYDE-FREE ELECTROLESS COPPER PLATING SOLUTIONS

FIELD OF THE INVENTION

This invention relates to electroless copper plating solutions, and more particularly to the use of certain chelating agents for electroless copper plating solutions that utilize dimethylamine borane as the reducing agent.

BACKGROUND OF THE INVENTION

Electroless copper plating baths are in widespread use in industry for depositing copper on non-conductive plastic substrates. In the manufacture of printed circuit boards, for example, electroless copper baths are used to deposit copper into the holes and/or circuit paths as a base for subsequent electrolytic copper plating. Electroless copper plating is also used in the decorative plastics industry for depositing copper onto the plastic surface as a base for further plating of copper, nickel, gold, silver, or other metals as required. The baths that are predominantly in use today usually contain a soluble divalent copper compound, a chelating or complexing agent for the divalent copper ions, a formaldehyde reducing agent, and various addition agents to make the bath more stable, plate at higher speed, or brighten the copper deposit. In spite of the fact that these baths are highly successful and widely used, the industry has been searching for alternative electroless copper plating baths that do not contain formaldehyde due to its toxic nature.

Hypophosphites have been suggested as a replacement for formaldehyde; however, plating rates of baths containing this compound are generally too slow. Dimethylamine borane alone has also been tried with varying degrees of success; however, there is no commercially successful plating bath to date that uses this reducing agent. The following patents are representative examples of the current state of the art in this area.

U.S. Pat. No. 3,431,120 proposes to use an electroless copper plating bath containing dimethylamine borane reducing agent with glucoheptanoic acid as a complexing agent. The pH range of these baths ranges from 3.5 to 7.

U.S. Pat. No. 3,870,526 discloses an electroless copper plating bath containing a dimethylamine borane reducing agent and ethylene diamine tetra-acetic acid ("EDTA") as the chelating agent, plus ammonium hydroxide to adjust the pH to the range of 8 to 11 (normally about 10.7).

U.S. Pat. No. 4,138,267 discloses an electroless copper bath having a pH between 12 and 14, sodium borohydride as the reducing agent, and various hydroxy substituted ethylene diamines as a chelating agent.

U.S. Pat. No. 4,143,186 proposes to use an electroless copper plating bath using dimethylamine borane reducing agents and various complexing agents, such as tartrates, acetates, glycolic acid, pyrophosphates, phosphates, EDTA, nitrilo-triacetic acid ("NTA"), ethylene diamine, triethylene tetra-amine, gluconic acid or gluconates at a pH range of 4 to 7.5. Triethanolamines are also mentioned as possible complexing agents.

U.S. Pat. No. 4,684,550 discloses a formaldehyde-free electroless copper bath using a dimethylamine borane reducing agent, an EDTA complexing agent, thio diglycolic acid as a stabilizer; an adduct of ethylene oxide and an acetylenic glycol as a surfactant and ammonium hydroxide to adjust the pH to the range of between and 11.5.

In all the above electroless copper plating baths, add tion agents are used to achieve stability of the platin bath and a bright colored copper deposit. These add tion agents are the same as those commonly used i formaldehyde containing electroless copper baths: cya nides, ferrocyanides, various sulfur-containing add tives, dipyridyl compounds and certain wetting agent None of the above prior art electroless copper bath achieved commercial success since they were either to unstable, too slow, emitted too high a degree of ammo nium hydroxide fumes, or gave poor coverage, an none of them discloses or teaches to utilize a pH rang of between 7.5 and 8. There still exists a wide sprea industry need, even to this date, for a formaldehyde-fre electroless copper plating bath that does not compro mise any of the good characteristics commonl achieved with the commercially used formaldehyde containing electroless copper baths. These characteris tics include a good plating rate, good copper colore deposits, good and complete coverage of the substrat by the deposit, good bath stability, and ease of contro

SUMMARY OF THE INVENTION

The present invention relates to a formaldehyde-fre electroless copper plating solution containing a solutio soluble divalent copper compound; a reducing agent fo the copper compound; a complex and chelating agen mixture of an amine alkanol compound having at leas one alkyl group of 1 to 3 carbon atoms, and an ethylen diamine compound of the formula

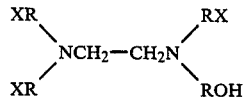

wherein R is an alkyl moeity having between 1 and carbon atoms and X can be —OH or —COOH. Thi solution has a pH between about 6 and 9 and a tempera ture above about 125° F. but below about 165° F. Also the complexing and chelating agent mixture is present i an amount sufficient to provide stability to the solutio and to enable the solution to provide a uniform platin rate of copper upon a substrate which is immerse therein.

The preferred reducing agent is dimethylamine borane and is present in the solution in an amount tha provides a copper ion or copper metal concentration o between about 1 and 3 g/l. The copper compound ma be present in a concentration of between ½ and 2 g/l Also, the amine alkanol compound is generally present in a concentration of between about 5 and 100 ml/l while the ethylene diamine compound is present in a concentration of between 1 and 10 g/l.

Preferred amine alkanol compounds include mono-, di- and tri-ethanol amines, while preferred ethylene diamine compounds include hydroxyethyl ethylene diamine triacetic acid; tetrahydroxy ethylene diamine and dihydroxymethyl ethylene diamine diacetic acid.

Advantageous electroless copper deposits and solution operation can be obtained by using the solution i the pH range of between 7.5 and 8 with essentially an complexing or chelating agent mixture in that the amount of dimethylamine borane reducing agent lost t side reactions is reduced to an extremely minimized an low value. An acid such as sulfuric acid can be added t the solution in an amount sufficient to adjust the pH to the desired range. The temperature should be maintained between about 130 and 150° F. for optimum results. Also, if desired, the solution may contain one or more addition agents for improving a characteristic of the solution or the resultant electroless copper deposit.

DETAILED DESCRIPTION OF THE INVENTION

This invention provides an electroless copper plating bath which uses the dimethylamine borane reducing agent and meets all the important characteristics commonly required by the industry. This bath also provides certain advantages over the conventionally used formaldehyde containing electroless copper plating baths, as follows:

1. The solutions of the invention contain no toxic formaldehyde.
2. There are no side reactions when the bath is idle, as is common to formaldehyde containing baths:
   a. Substantially no plating out of copper ions occurs—the reaction ceases when the bath temperature falls to ambient.
   b. A longer bath life is achieved with less by-product build up therein.
3. Less copper ion contamination of the rinse water is found due to the lower copper metal content of the plating bath.
4. Simple waste treatment of spent bath is possible, since no formaldehyde is present and copper is easily removed as metal.
5. Improved adhesion to most substrates is obtained due to slow catalytic initiation.
6. The ability to metallize alkaline sensitive substrates such as polyimides with improved adhesion.
7. Better stability and shelf life.

The preferred plating bath contains divalent copper added as a soluble copper compound, dimethylamine borane as the reducing agent, and a complexing and chelating agent mixture, preferably of ethanol amines and hydroxyalkyl substituted ethylene diamine based compounds, with a pH range of between 6 and 9. It was surprisingly found that the mixture of chelating agents with complexing agents supplied the desirable characteristics of the electroless copper bath, whereas the use of alkanol amine complexing agents or hydroxyalkyl substituted ethylene diamine chelating agents by themselves, instead of in combination, are not successful.

Although the inventor does not wish to be held to any particular theory, it is believed that this mixture of complexing and chelating agents imparts to the solution the correct copper stability constant at the operating pH and is capable of both metering and releasing the copper ions at the most desirable rate to result in a highly successful electroless copper plating bath. Although both the alkanol amines and the ethylene diamine based chelating agents have been separately suggested by the prior art as being useful, neither has been commercially acceptable when used alone, since the resultant plating baths did not provide all the necessary performance characteristics. It is only the mixture of these materials as disclosed herein that will result in a plating bath that has all of the necessary characteristics for successful commercial operation.

The pH of the plating bath is very important since the pH, as well as the complexing and chelating agent mixture, will have an effect on the stability constant of copper in the bath. If the pH falls below 7.5, the plating rate starts to diminish and becomes unacceptable below a pH of about 6. If the pH rises above 8, the plating rate and bath instability begins to increase until a pH of 9, above which the bath cannot be used. The pH should also be kept as close to neutral as possible in order to maintain the correct reduction potential of the dimethylamine borane reducing agent. At lower or higher pH values, the dimethylamine borane readily undergoes hydrolysis and/or rapid decomposition, thus rendering the solution unsuitable for use in electroless plating.

The conventional formaldehyde-containing electroless copper tends to lose formaldehyde during use and during idle periods, due to the inherent instability of formaldehyde in the alkaline bath. Similarly, dimethylamine borane ("DMAB") has a degree of instability due to hydrolysis of the compound when used outside the pH range disclosed. DMAB is an expensive material, far more so than formaldehyde, therefore any loss other than that which is consumed in depositing copper cannot be tolerated by the end user, since it results in a substantial increase in operating costs.

It has been found that operation of the electroless copper bath within the narrow pH range of 7.5 to 8 is most economical since there is very little, if any, loss of DMAB due to extraneous reactions. Such reactions are essentially avoided by operating in this pH range, with all or practically all of the DMAB being consumed in the plating of copper. Although it is possible to operate an electroless copper bath at pH values outside of the narrow range of 7.5–8, the economical advantage of this pH range is substantial. Substantially all prior art electroless copper baths using DMAB operate at pH values above or below this range, and the inventor is not aware of anyone skilled in the art who recognized the importance or desirability of operating solely between the pH values of 7.5 to 8, inclusive.

Since the amount of DMAB lost to extraneous reactions is minimal, the amount of DMAB to be added to the solution is maintained at the exact stoichiometric amount needed for the reduction of copper. This is quite unexpected since the prior art in general teaches that an excess, usually a substantial excess, of DMAB is consumed during reduction of copper. By maintaining the pH within the narrow range described above, the use of such excess amounts of DMAB is avoided, even with the use of any complexing and chelating agent mixture.

The operating temperature of the electroless copper plating bath is also an important variable, since it has a strong effect on the rate of reaction between the reducing agent and the copper ions. Below about 130° F., the reaction rate starts to diminish and the plating rate decreases. Above 160° F., the reaction rate increases, the plating rate increases, and the bath begins to show some instability. The preferred temperature range is about 130° to 150° F.

Copper can be added to the bath as any solution-soluble compound as long as the anion is not harmful to the plating bath. Suitable copper salts are copper sulfate, copper chloride, copper nitrate, copper hydroxide, copper sulfamate and the like. The concentration of copper in the plating bath is critical since it has a substantial effect on the reaction rate. The copper ion concentration in the plating bath can vary from ½ to 2 g/l, with about 1 g/l preferred. When the concentration falls below 1 g/l, the plating rate begins to diminish and below about ½ g/l, the plating rate becomes too slow to be practical. When the copper ion concentration goes above 1 g/l, the plating rate begins to increase and the bath begins to become unstable above about 2 g/l. The bath can operate at concentrations somewhat above 2 g/l if the temperature of operation is reduced and if the concentration of the complexing and chelating agent mixture is increased.

The reducing agent includes any of the known amine boranes, such as, for example, those disclosed in U.S. Pat. No. 3,431,120. The most preferred reducing agent is dimethyl amine borane.

The dimethylamine borane concentration is generally about 2 g/l but is not critical to the proper operation of the baths of the invention. Below about 1 g/l, the reaction rate starts to diminish, so that the concentration should not be much below 1 g/l. Above the desired 2 g/l concentration, the reaction rate increases somewhat. Above about 3 g/l, the bath is still operable; however, high concentrations are not practical since, as noted above, the dimethylamine borane is very costly and its concentration should therefore be kept at the minimum required.

The term "complexing and chelating agent mixture" is used to designate the combination of ingredients needed to impart the previously described properties to the bath. Amine alkanol compounds having at least one alkyl group of 1 to 3 carbon atoms are useful as the complexing agent portion of the mixture, with mono-, di- and triethanol amines being preferred. The concentration of this component is also not critical and can vary from 5 ml/l to 100 ml/l, with 25 ml/l to 75 ml/l preferred. The portion of this mixture directed to a chelating agent includes substituted ethylene diamine compounds in which any one or all four of the terminal hydrogen atoms in the ethylene diamine molecule are replaced by either a hydroxy alkyl moeity or a carboxy alkyl moeity. Thus, suitable ethylene diamine compounds can be represented by the formula:

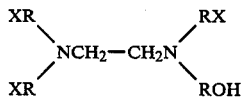

wherein R is an alkyl moeity having between 1 and 3 carbon atoms and X is —OH or —COOH. Examples include: hydroxyethyl ethylene diamine triacetic acid, tetrahydroxyethyl ethylene diamine, dihydroxymethyl ethylene diamine diacetic acid, or the like. Additional hydroxyalkyl substituted ethylene diamines which are suitable in the solutions of the present invention are disclosed in U.S. Pat. No. 4,138,267, although the compounds discussed above are preferred.

The concentration of the chelating agent is also not critical and can vary from 1 g/l to 10 g/l, with 4 g/l to 6 g/l preferred. Since specifically controlled concentrations and ratios of materials in the mixture are not required, many different formulations based on mixtures of these materials are possible, and one skilled in the art can determine by routine testing which combinations provide optimum results for their specific bath or intended application.

Addition .agents commonly used in the prior art are also useful in the formaldehyde-free copper baths of this invention, with similar improvements achieved in the bath and deposit characteristics. As noted above, these agents include various solution soluble cyanides, ferrocyanides, cyanates, sulfur containing compounds such as sulfides, thio compounds and the like, dipyridyl compounds and certain wetting agents or surfactants, such as those disclosed in U.S. Pat. No. 4,684,550.

EXAMPLES

The scope of the invention is further described in connection with the following examples which are set forth for the sole purpose of illustrating the preferred embodiments of the invention and which are not to be construed as limiting the scope of the invention in any manner.

EXAMPLE 1

A 4 liter bath is made containing 1 g/l copper metal as $CuSO_4$ $5H_2O$; a copper complexing and chelating agent mixture of 50 ml/l triethanolamine and 5 g/l N-hydroxyethyl ethylene diamine triacetic acid; and 2 g/l dimethylamine borane. The pH was adjusted to 7.5 with a 25% solution of sulfuric acid. As a bath stabilizer, 2.2 ppm of sodium sulfide and 8 ppm of sodium thiocyanate is added. The bath contained in a 4 liter beaker and heated to 140° F. on a hot plate equipped with a magnetic stir bar. Solution agitation is supplied solely by the spinning bar.

A 4.5"×6" drilled copper clad epoxy laminate plus a 3" square of non-drilled base epoxy laminate is processed through a conventional palladium/tin activation process and then immersed in the bath for 40 minutes. The drilled board after plating is examined for coverage of the thru-holes and adhesion to the holes and clad surfaces by the techniques used in the art. The adhesion and coverage of the electroless deposit produced from this bath was found to be excellent. The salmon pink deposit appearance is the same as that obtainable from a conventional formaldehyde type bath. The thickness of deposit was determined from the non-drilled board to be 60 microinches thick.

The cycle was then repeated with new unplated boards for a total of 64 cycles. The bath was replenished after each cycle with copper metal replenisher, dimethylamine borane, stabilizer, and small amounts of the chelating mixture to replace drag out losses and to maintain the pH at 7.5. The bath was operated in this fashion for 6.1 metal turnovers with a constant plating rate, deposit color, and solution stability.

The amount of DMAB needed to reduce the amount of copper that was deposited was calculated to be 26 grams, while the amount of DMAB added to the solution over the time period was 28 grams. Only 2 grams of DMAB was lost to side or extraneous reactions, thus illustrating the efficiency of the inventive bath.

EXAMPLE 2

(comparative)

A 4 liter bath was made in the same manner as Example 1 except that only the triethanolamine was used in place of the complexing and chelating agent mixture. The bath decomposed while plating the first boards.

EXAMPLE 3

(comparative)

A 4 liter bath was made in the same manner as Example 1 except that only the N-hydroxyethyl ethylene diamine triacetic acid was used in place of the complexing and chelating agent mixture. After 40 minutes, essentially no deposited metal could be observed on the boards.

EXAMPLE 4

In this example, the bath of Example 1 was repeated except that the pH was adjusted to 6. During plating, the bath exhibited signs of inactivity by the observed decreased gas evolution, and the time to obtain coverage was substantially increased. After 40 minutes plating time, the thickness of the deposit was only 20 microinches. The bath was not tested further.

EXAMPLE 5

(comparative)

In this example, the bath of the Example 1 was repeated, except that the pH was adjusted to 9.5. Shortly after plating had begun to take place, the bath decomposed, precipitating copper metal on the walls of the beaker.

EXAMPLE 6

Two samples of the bath of Example 1 were prepared. One was adjusted to a pH of 6.9 by addition of a 25% solution of sulfuric acid.

Bath samples were analyzed for DMAB at the start and were adjusted to be 2 grams per liter. These samples were then allowed to set for one week before again being analyzed for DMAB. The 6.9 pH sample was found to contain 1.6 g/l DMAB, while the 7.5 pH sample contained 1.9 g/l. Thus, consumption of DMAB was 20% for the 6.9 pH sample, and only 5% for the 7.5 pH sample. This test clearly demonstrates the importance of operating in the pH range disclosed.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A formaldehyde-free electroless copper plating solution comprising:

a solution soluble divalent copper compound;

an amine borane reducing agent for said copper compound;

a complexing and chelating agent mixture of an amine alkanol compound having at least one alkyl group of 1 to 3 carbon atoms and an ethylene diamine compound of the formula

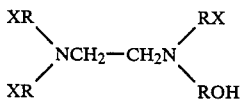

wherein R is an alkyl moeity having between 1 and 3 carbon atoms and X is —OH or —COOH;

said solution having a pH above about 6 but less than about 9 and a temperature above about 125° F. but below about 165° F., said complexing and chelating agent mixture being present in an amount sufficient to provide stability to the solution and to enable the solution to provide a uniform plating rate of copper upon a substrate which is immersed therein.

2. The solution of claim 1 wherein the reducing agent is dimethylamine borane and is present in the solution in a concentration of between about 1 and 3 g/l.

3. The solution of claim 1 wherein the amine alkanol compound is present in the solution in a concentration of between about 5 and 100 ml/l.

4. The solution of claim 1 wherein the amine alkanol compound is a mono-, di- or tri-ethanol amine.

5. The solution of claim 1 wherein the ethylene diamine compound is present in the solution in a concentration of between about 1 and 10 g/l.

6. The solution of claim 1 wherein the ethylene diamine compound is hydroxyethyl ethylene diamine triacetic acid; tetrahydroxy ethylene diamine; or dihydroxymethyl ethylene diamine diacetic acid.

7. The solution of claim 1 further comprising one or more addition agents for improving the characteristics of the solution or the resultant electroless copper deposit.

8. The solution of claim 1 wherein the pH range is between 7.5 and 8 and wherein the temperature is between about 130° and 150° F.

9. The solution of claim 8 which further comprises an acid in an amount sufficient to adjust the pH to the desired range.

10. The solution of claim 1 wherein the copper compound is present in an amount which provides a copper ion concentration of between ½ and 2 g/l.

11. A formaldehyde-free electroless copper plating solution comprising:

a solution soluble divalent copper compound in an amount which provides a copper ion concentration of between about ½ and 2 g/l;

an amine borane reducing agent for said copper compound in a concentration of between about 1 and 3 g/l;

a complexing and chelating agent mixture of between about 5 and 100 ml/l of an amine alkanol compound having at least one alkyl group of one to three carbon atoms and between about 1 and 10 g/l of an ethylene diamine compound of the formula

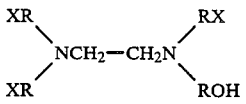

wherein R is an alkyl moeity having between 1 and 3 carbon atoms, and X is —OH or —COOH;

said solution having a pH between about 7 and 8.5 and a temperature between about 130° and 150° F.; F.;

said complexing and chelating agent mixture being present to provide stability to the solution and to enable the solution to provide a uniform plating rate of copper upon a substrate which is immersed therein.

12. The solution of claim 11 wherein the reducing agent is dimethylamine borane.

13. The solution of claim 11 wherein the amine alkanol compound is a mono-, di- or tri-ethanol amine.

14. The solution of claim 11 wherein the ethylene diamine compound is hydroxyethyl ethylene diamine triacetic acid; tetrahydroxy ethylene diamine; or dihydroxymethyl ethylene diamine diacetic acid.

15. The solution of claim 11 further comprising one or more addition agents for improving a characteristic of the solution or the resultant electroless copper deposit.

16. The solution of claim 11 which further comprises an acid in an amount sufficient to adjust the pH to the desired range.

17. The solution of claim 11 wherein the amine alkanol compound is present in the solution in a concentration of between about 25 and 75 ml/l.

18. The solution of claim 11 wherein the ethylene diamine compound is present in the solution in an amount of between about 4 and 6 g/l.

19. A formaldehyde-free electroless copper plating solution comprising:

a solution soluble divalent copper compound;

dimethyl amine borane as a reducing agent for said copper compound; and one of a complexing agent, a chelating agent or a mixture thereof;

said solution having a pH of between 7.5 and 8 and a temperature between about 130° and 150° F., said complexing or chelating agent being present to provide stability to the solution and to enable the solution to provide at the stated pH range a uniform plating rate of copper upon a substrate which is immersed therein without appreciable loss of the reducing agent due to extraneous reactions other than the reaction required for electrolessly depositing copper, said solution being substantially free of ammonium ions so as to avoid generating ammonium fumes during electroless plating.

20. The solution of claim 19 wherein the copper compound is present in an amount which provides a copper ion concentration of between about ½ and 2 g/l, the reducing agent is present in an concentration of between about 1 and 3 g/l, and the complexing and chelating mixture is a mixture of an amine alkanol compound in a concentration of between about 5 and 100 ml/l and an ethylene diamine compound of the formula

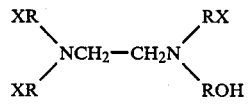

wherein R is an alkyl moeity having between 1 and 3 carbon toms, and x is —OH or —COOH in a concentration of between bout 1 and 10 g/l.

21. A formaldehyde-free electroless copper plating solution comprising:

a solution soluble divalent copper compound;

dimethyl amine borane as a reducing agent for said copper compound; and one of a complexing agent, a chelating agent or a mixture thereof;

said solution having a pH of between 7.5 and less than 8 and a temperature between about 130° and 150° F., said complexing or chelating agent being present to provide stability to the solution and to enable the solution to provide at the stated pH range a uniform plating rate of copper upon a substrate which is immersed therein without appreciable loss of the reducing agent due to extraneous reactions other than the reaction required for electrolessly depositing copper.

22. A formaldehyde-free electroless copper plating solution comprising:

between about ½ and 2 g/l of copper ions from a solution soluble divalent copper compound;

between about 1 and 3 g/l of dimethyl amine borane as a reducing agent for said copper compound;

one of a complexing agent, a chelating agent or a mixture thereof; and an acid to adjust the pH of said solution to between 7.5 and 8, said solution having a temperature between about 130° and 150° F., said complexing or chelating agent being present to provide stability to the solution and to enable the solution to provide at the stated pH range a uniform plating rate of copper upon a substrate which is immersed therein without appreciable loss of the reducing agent due to extraneous reactions other than the reaction required for electrolessly depositing copper.

* * * * *